US009107460B1

(12) United States Patent
Synn et al.

(10) Patent No.: US 9,107,460 B1
(45) Date of Patent: Aug. 18, 2015

(54) WEAVABLE WIG FOR SEWING INTO A USER'S HAIR

(71) Applicant: Midway International, Inc., Cerritos, CA (US)

(72) Inventors: Sun Ok Synn, Fullerton, CA (US); Audrey Han, Cypress, CA (US); Tao Lin, Qingdao (CN); Yang Chunyan, Qingdao (CN)

(73) Assignee: Midway International, Inc., Cerritos, CA (US)

( * ) Notice: Subject to any disclaimer, the term of this patent is extended or adjusted under 35 U.S.C. 154(b) by 0 days.

(21) Appl. No.: 14/269,775

(22) Filed: May 5, 2014

(51) Int. Cl.
*A41G 3/00* (2006.01)

(52) U.S. Cl.
CPC ..... *A41G 3/0008* (2013.01)

(58) Field of Classification Search
CPC ..... A41G 3/00; A41G 3/0008; A41G 3/0016; A41G 3/0033; A41G 3/0041; A41G 3/005; A41G 5/002
See application file for complete search history.

(56) References Cited

U.S. PATENT DOCUMENTS

| | | | | |
|---|---|---|---|---|
| 2,438,005 | A * | 3/1948 | Goldman | 132/53 |
| 2007/0034221 | A1 * | 2/2007 | Chung | 132/53 |
| 2009/0199861 | A1 * | 8/2009 | Paris | 132/201 |
| 2014/0251362 | A1 * | 9/2014 | Lee | 132/201 |

* cited by examiner

*Primary Examiner* — Rachel Steitz
(74) *Attorney, Agent, or Firm* — Booth Udall Fuller, PLC

(57) ABSTRACT

A weaveable wig comprising a cap comprising front and back edges, the cap comprising a reinforced fabric portion having a first edge forming a portion of a perimeter of the front edge of the cap, a plurality of longitudinal weft-securing members coupled to the second edge of the reinforced fabric portion and extending to the back edge of the cap, and at least one hair-part inlay extending from the perimeter of the cap at the front edge toward a crown of the cap within the reinforced fabric portion, the hair-part inlay comprising a reinforced border surrounding the hair-part inlay except along the front edge. The weaveable wig further comprises a plurality of hair wefts coupled laterally across at a least a portion of the plurality of longitudinal weft-securing members and a weaving band comprising an elastic mesh material extending outward from a majority of the perimeter of the cap.

4 Claims, 7 Drawing Sheets

WEAVABLE WIG FOR SEWING INTO A USER'S HAIR

BACKGROUND

1. Technical Field

Aspects of this document relate generally to hairpieces and wigs that may be sewn into a user's own hair.

2. Background Art

Currently existing wigs suffer from many drawbacks such as being made from scratchy or uncomfortable materials that cause irritation and itching of the wearer's scalp. Additionally, most wigs are attached to the wearer's head using clips, combs, or adhesives which do not adequately secure the wig and causes the wearer to feel as though the wig may slip off or become unintentionally detached.

Another option for those seeking to modify or enhance the look of their own, natural hair is the hair weave, in which wefts of artificial or real human hair are sewn to the user's head. This is traditionally a time consuming and expensive process as the wearer's own hair must be carefully braided or otherwise secured in rows and the entire head is then covered with a mesh or other material to create a surface to sew the wefts of hair to. The cost and time involved can be undesirable for users who are seeking versatility and cost-effectiveness in their hair enhancement option.

SUMMARY

Implementations of a weaveable wig may comprise a cap comprising a front edge and a back edge, the cap comprising a reinforced fabric portion having a first edge forming a portion of a perimeter of the front edge of the cap and a second edge, a plurality of longitudinal weft-securing members coupled to the second edge of the reinforced fabric portion and extending to the back edge of the cap, and at least one hair-part inlay extending from the perimeter of the cap at the front edge toward a crown of the cap within the reinforced fabric portion, the hair-part inlay comprising a reinforced border surrounding the hair-part inlay except along the front edge. The weaveable wig may further comprise a plurality of hair wefts coupled laterally across at a least a portion of the plurality of longitudinal weft-securing members and a weaving band comprising an elastic mesh material, the weaving band extending outward from a majority of the perimeter of the cap.

Particular aspects may comprise one or more of the following features. The weaving band may extend further outward from the perimeter of the cap than the plurality of hair wefts coupled to the longitudinal weft securing members. The elastic mesh material may be comprised of nylon and spandex. The elastic mesh material may comprise openings configured to pass a weaving needle therethrough. The reinforced border may be comprised of a material having sufficient strength to prevent tearing of the hair-part inlay beyond the reinforced border when the hair-part inlay is cut. The hair-part inlay may further comprise hair adhered to an outer surface of the hair-part inlay. At least one of the reinforced fabric portion and the hair-part inlay may be comprised of a non-elastic material.

Implementations of a weaveable wig may comprise a cap comprising a plurality of longitudinal weft-securing members comprised of an elastic material and a hair-part inlay extending from the perimeter of the cap toward a crown of the cap, the hair-part inlay comprised of a non-elastic fabric and at least partially surrounded by a reinforced border, a plurality of hair wefts coupled laterally across at a least a portion of the plurality of longitudinal weft-securing members such that none of the hair wefts perpendicularly cross the hair-part inlay, and a weaving band comprising an elastic mesh material and extending outward from at least a portion of the perimeter of the cap.

Particular aspects may comprise one or more of the following features. The weaving band may extend further outward from the perimeter of the cap than the plurality of hair wefts coupled to the longitudinal weft securing members. The elastic mesh material may be comprised of nylon and spandex. The elastic mesh material may comprise openings configured to pass a weaving needle therethrough. The reinforced border may be comprised of a material having sufficient strength to prevent tearing of the hair-part inlay beyond the reinforced border when the hair-part inlay is cut. The hair-part inlay may further comprise hair adhered to an outer surface of the hair part inlay. The hair-part inlay may be comprised of a non-elastic material.

Implementations of a method of securing a weaveable wig to a user's head comprising stretching a cap of a weaveable wig over the head of the user, sewing, using a weaving needle and thread, only a weaving band comprising an elastic mesh material that extends outward from a majority of a perimeter of the cap to at least a portion of a perimeter of a user's hair without sewing any of the cap of the weaveable wig to the user's hair, and cutting away at least a portion of the elastic mesh material of the weaving band after the weaving band has been sewn to the at least a portion of the perimeter of the user's hair.

Particular aspects may comprise one or more of the following features. The method may further comprise providing a sewing base around the at least a portion of the perimeter of the user's hair by braiding at least a portion of the perimeter of the user's hair. The method may further comprise providing a sewing base around the at least a portion of the perimeter of the user's hair by braiding less than all of the user's hair. The elastic mesh material may be comprised of nylon and spandex and is of a strength great enough to prevent tearing of the elastic mesh when tension is applied to the thread when sewing the weaving band to the at least a portion of the perimeter of the user's head.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventor is fully aware that he can be his own lexicographers if desired. The inventor expressly elects, as his own lexicographers, to use only the plain and ordinary meaning of terms in the specification and claims unless clearly stated otherwise and then further, expressly sets forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112(f). Thus, the use of the words "function," "means" or "step" in the Description, Drawings, or Claims is not intended to somehow indicate a desire to invoke the special provisions of 35 U.S.C. §112(f), to define the invention. To the contrary, if the provisions of 35 U.S.C. §112(f) are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112(f). Moreover, even if the provisions of 35 U.S.C. §112 (f) are invoked to define the claimed disclosure, it is intended that the disclosure not be limited only to the specific structure, material or acts that are described in preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components and materials disclosed herein. Many additional components, materials, and manufacturing procedures known in the art consistent with weaveable wigs are in use with particular implementations from this disclosure. Accordingly, although particular implementations are disclosed, such implementations and implementing components may comprise any components, models, versions, materials, and/or the like as is known in the art for such systems and implementing components, consistent with the intended use.

The many drawbacks of traditional wigs include the fact that the wig itself can feel foreign and uncomfortable on the wearer's head, much like wearing a hat, and can be made of uncomfortable materials that result in an unnatural feeling, scalp irritation, or general discomfort. Additionally, the wig may be difficult to secure to the wearer's head using combs, clips, or adhesives, which may result in the wig deviating from its intended position during wear or falling off of the wearer's head entirely. A pleasing hair pattern around the part and ability of the wearer to give the appearance of a natural and comfortable hair part are also difficult to achieve using conventional wigs. Traditional lace wigs have a band of lace or lace-like material extending down from the hairline and onto the user's forehead to in an effort to create a natural-looking hairline. This lace, which may also be present on the inside of the wig cap, may be scratchy an irritating to the user's skin and scalp and may easily tear. These traditional lace wigs may also require an additional step to secure the wig to the user's head, such as taping or gluing.

In the current art, for users seeking added security of a hairpiece to prevent the hairpiece from shifting or falling off of the head, hair weaving is another option. This process has traditionally involved braiding or otherwise securing rows of the user's hair, to which an overall mesh or other fabric layer is then sewn to provide a foundation for individual hair wefts to be sewn to the mesh or fabric to create the look of the user's desired hairstyle. Thus, traditional hair weaving requires a great deal of time and expense due to the materials and labor involved, which makes the process unaffordable and impractical for many people.

Implementations of the disclosed system and methods offer a convenient and economic alternative to traditional hair weaving or wigs while providing a natural looking hairstyle by providing a weaveable wig that is easy to attach to a user's head yet has the security of a hair weave with a natural look. By requiring only partial sewing to secure the weaveable wig to the user's head, attaching the weaveable wig requires significantly less time than a traditional hair weave.

Figure 1:
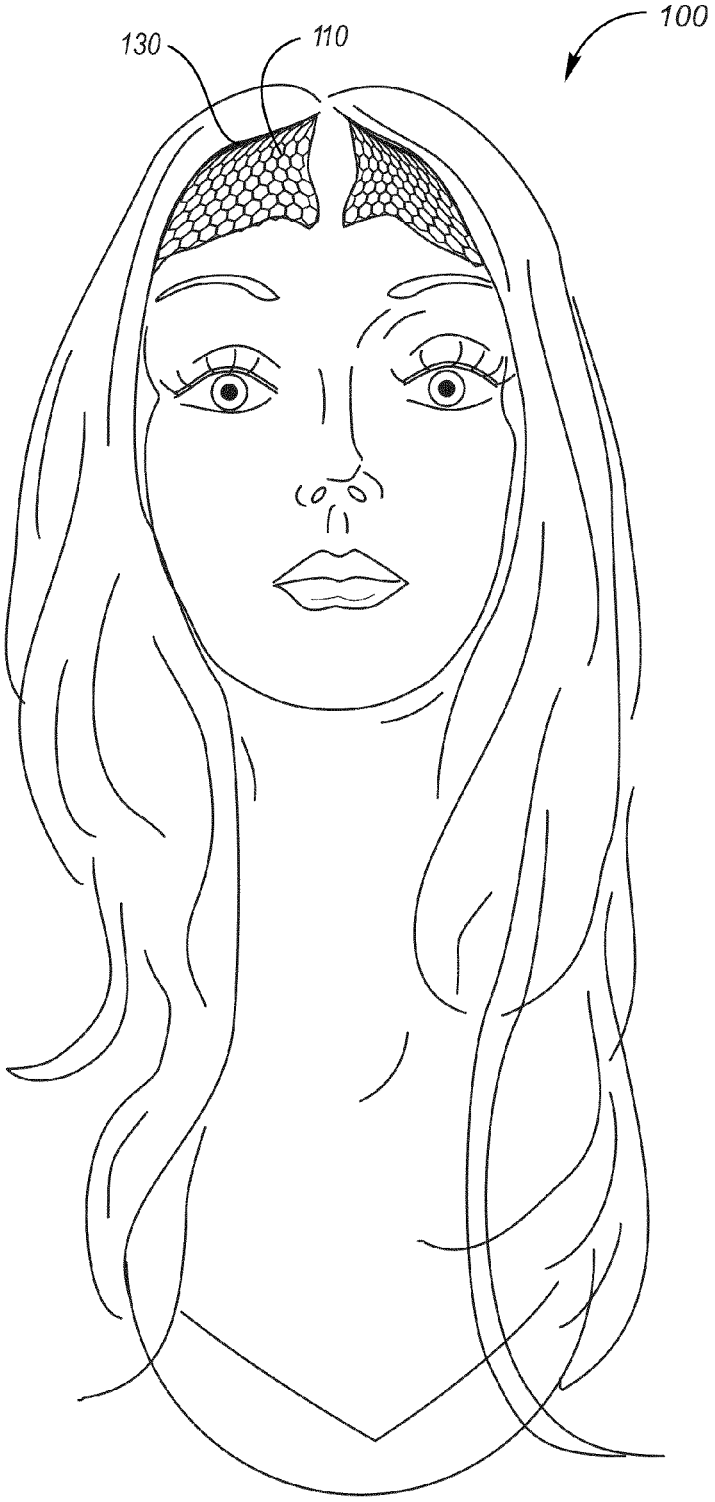
FIGS. 1-2 depict an implementation of a weaveable wig prior to being woven into a user's natural hair.
Figure 2:
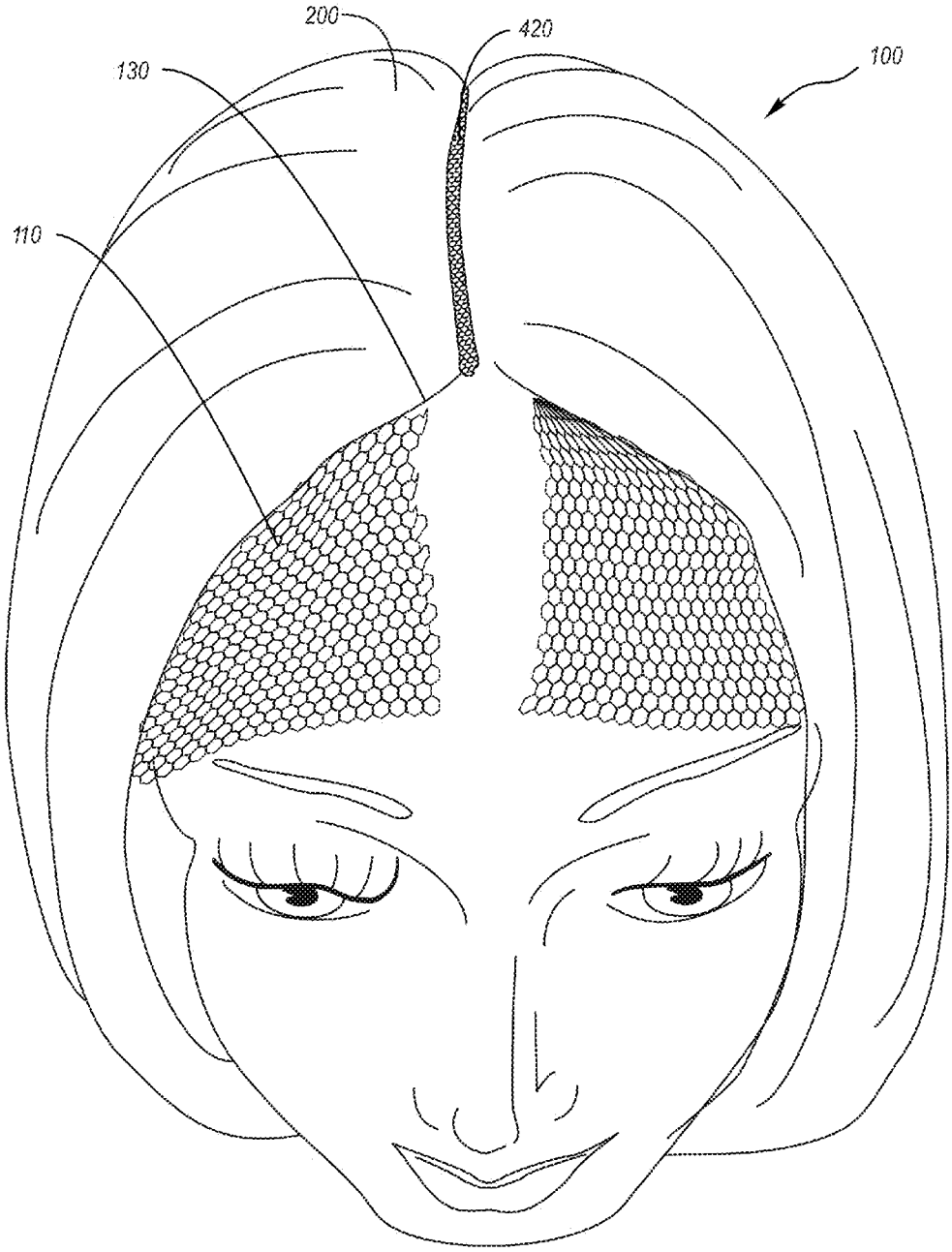

As shown in FIGS. 1-2, implementations of a weaveable wig 100 may provide the user with a pre-styled, ready to wear hairstyle that reduces styling and finishing time. Prior to the weaveable wig being partially sewn to the user's head, a perimeter of the user's natural hair is braided or otherwise secured around at least a portion of the user's hairline. The wig itself is then fitted or stretched over the user's head and natural hair and aligned so that the hairline 130 of the weaveable wig is aligned with the user's natural or desired hairline. A weaving band 110 comprised of an elastic mesh may then be sewn to the perimeter of the user's hair that has previously been braided or secured.

Figure 3:
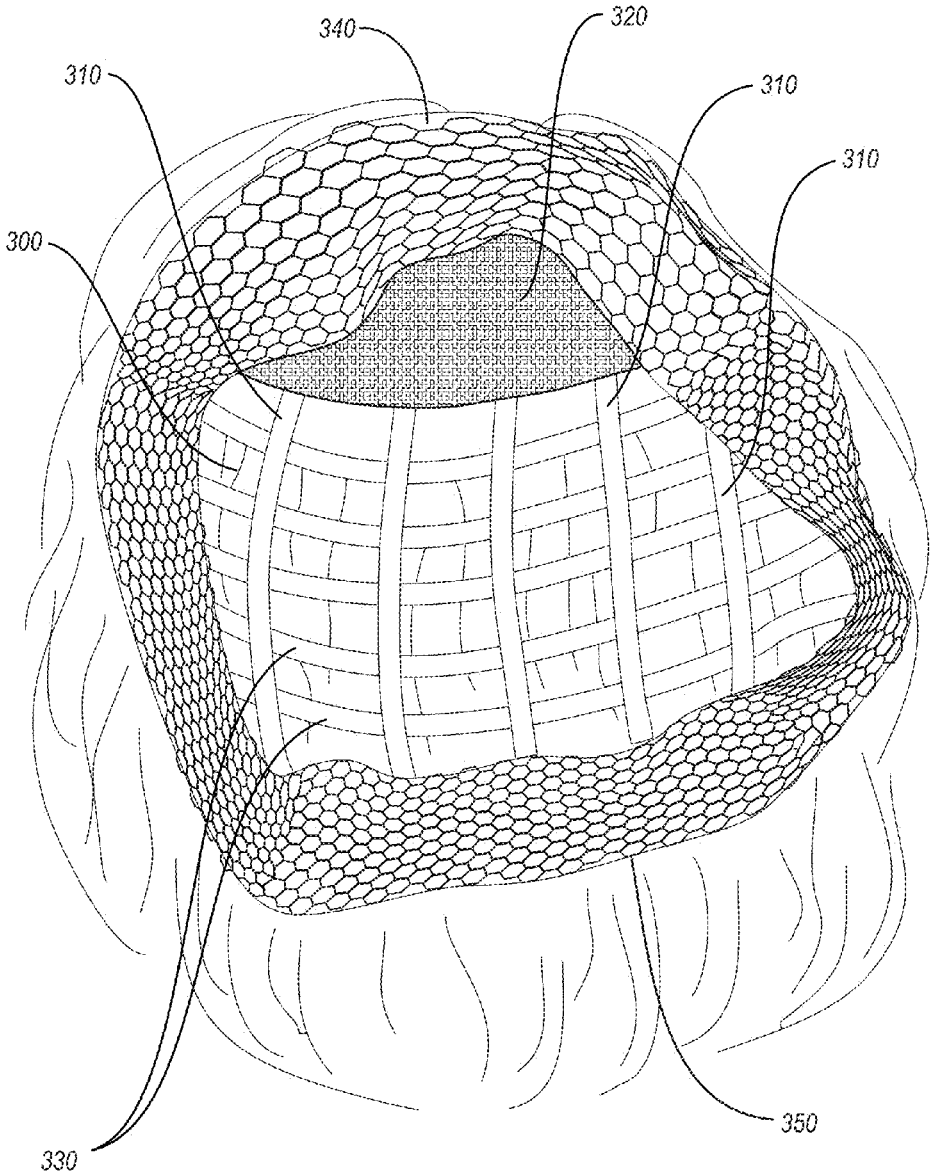
FIG. 3 depicts an inner view of a cap in accordance with an implementation of a weaveable wig.
Figure 4A:
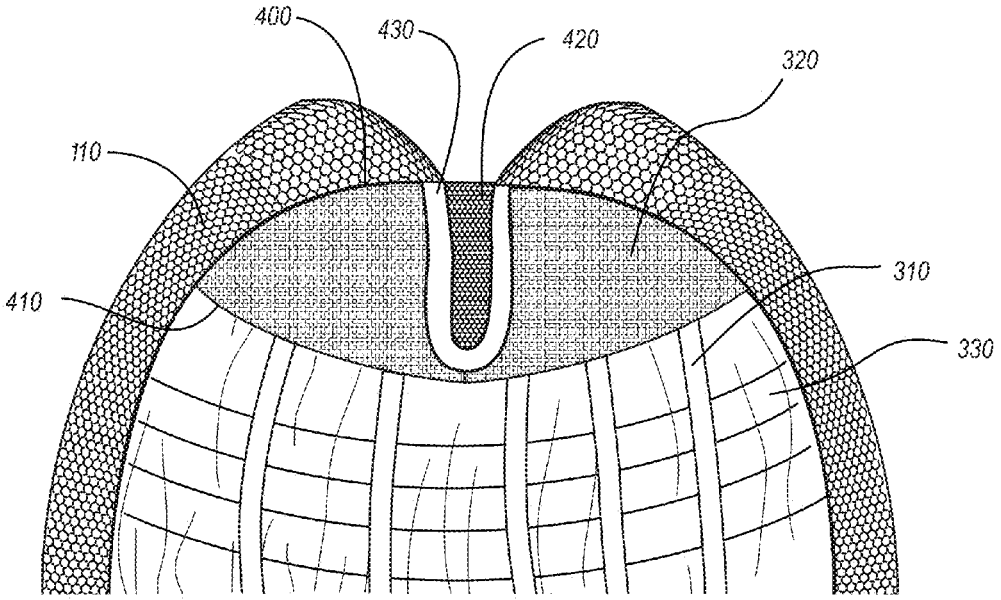
FIGS. 4A-B provides close-up views of a portion of an inside of an implementation of a weaveable wig comprising a hair-part inlay and reinforced border.

FIG. 3 provides a more detailed view of an implementation of a weaveable wig from inside the wig cap itself. As shown, the cap 300 comprises a plurality of elastic weft-securing members 310 that run longitudinally relative to the wearer's head when the weaveable wig is worn by a user. In some implementations the cap 300 further comprises a reinforced fabric portion 320 having a first edge 400 (FIGS. 4A-B) forming a portion of the perimeter of the cap and a second edge 410 to which at least a portion of the plurality of longitudinal weft-securing members 310 is coupled. A plurality of hair wefts 330 may be coupled laterally across the longitudinal weft-securing members 310. As known in the art, the hair wefts 330 may be comprised of artificial or real human hair that is secured to the weft and extends from the weft perpendicularly to the strip of fabric, thread, or other material to which the hair is sewn or otherwise adhered to. The elastic weft-securing members 310 may be comprised of any stretchable, elastic material such as for example, spandex, nylon, or other synthetic materials. The elastic nature of the weft-securing members 310 which not only hold the hair wefts 330 in place, but also provide form and structure to the cap, allows the cap to conform to fit a user's head without being loose or baggy, which helps to create a natural looking hairstyle that moves with the user's head without moving or slipping around like many conventional wigs do.

Figure 5:
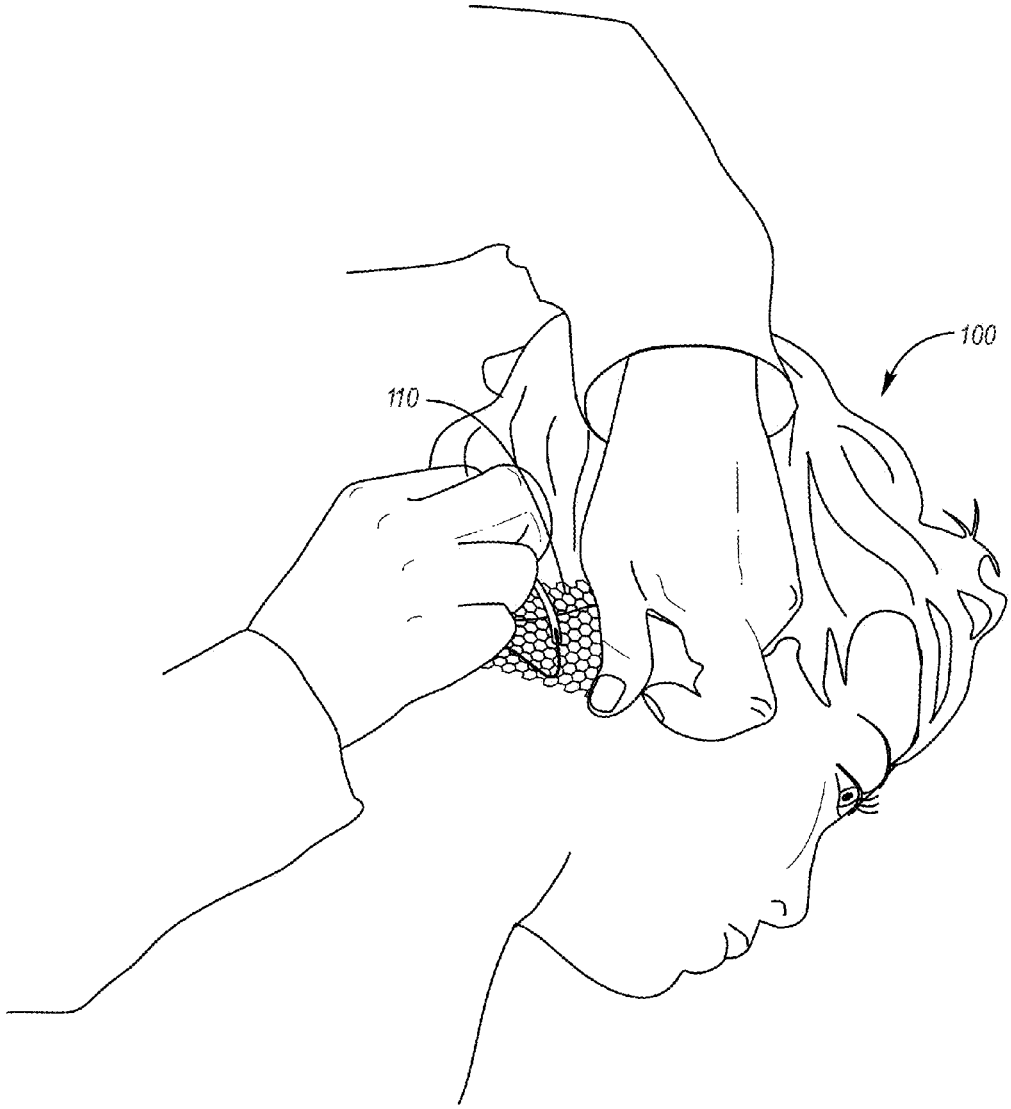
FIG. 5 depicts an implementation of a weaveable wig being installed on a user's head.

As shown in FIG. 3, a weaving band 110 extends outward from at least a portion of the perimeter of the cap 300. The weaving band 110 may be comprised of an elasticized mesh that is comprised of elastic, nylon, spandex, or any other synthetic or stretchable fibers that one of ordinary skill in the art would deem appropriate to use. The mesh is preferably configured such that the openings in the mesh are sufficient to allow a weaving or other needle to pass therethrough so that the weaving band 110 may be sewn to the braids or other portions of hair at or near a user's hairline as shown in FIG. 5, which shows the back 350 of the weaveable wig being sewn to the user's own hair. The flexibility and stretchiness of the elastic mesh of the weaving band 110 allow the weaveable wig to be securely fastened to the user's head without the use of uncomfortable materials to do so. While the size of the openings in the elastic mesh of the weaving band may vary to accommodate different degrees of stretchiness associated with different blends of materials comprising the elastic mesh, in some implementations, it may be preferable for the elastic mesh to have openings in the range of approximately 1-5 millimeters. Due to its soft and flexible, yet strong nature, the mesh is comfortable on the hairline or scalp of the user. Although FIG. 5 depicts a full-wig implementation of a weaveable wig, implementations may comprise a half-wig or other appropriately sized wig that may be secured to a user's natural hair anywhere on the user's head. Regardless of whether the embodiment is a full-wig or half-wig style, it is not necessary to braid or secure all of the user's hair over the entire head. It only needs to be secured in the areas needed to secure the weaving band 110 to the user's own hair. As such, significant labor cost and time savings may be achieved by this added efficiency. Once the weaving band 110 has been sewn to the user's hair, any excess mesh of the weaving band 110 may be trimmed away to provide a natural look. Implementations of the weaveable wig may be also be easily removed after installation by cutting the thread securing the weaving band 110 to the user's natural hair and the weaveable wig may be reused as many times as the user desires.

Figure 4B:
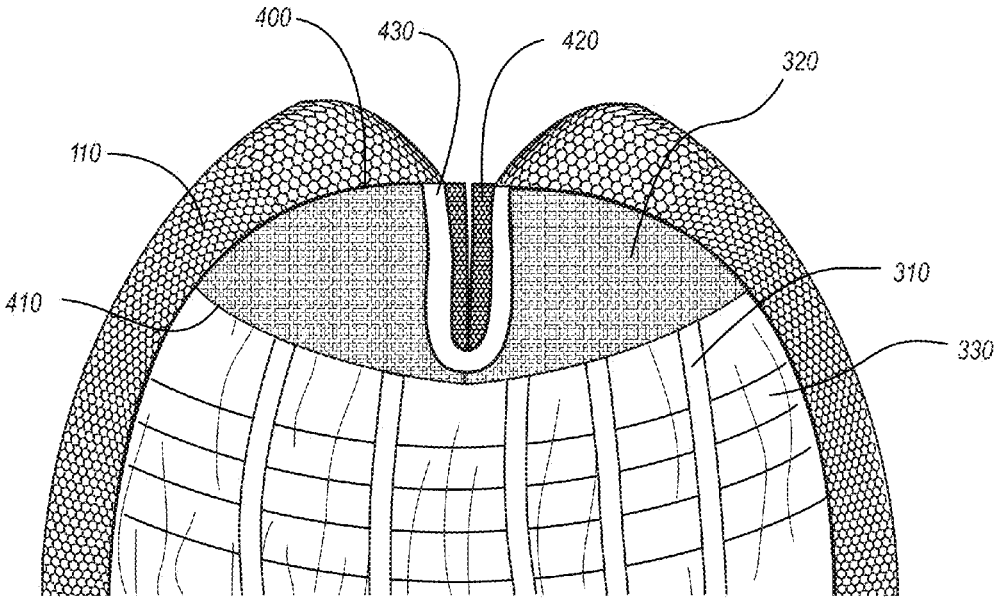

Some implementations of the weaveable wig further comprise a hair-part inlay 420 which may be located within the reinforced fabric portion 320 of the cap. While any alignment of the hair-part inlay 420 may be used to achieve a desired hairstyle, in some embodiments, the hair-part inlay 420 may extend from the first edge 400 of the reinforced fabric portion 320 at the perimeter of the cap inward toward the crown 200 of the cap 300. Depending upon the placement, the hair-part inlay 420 may be used to create a center or side hair part. The hair-part inlay 420 may be comprised of any material, however, more delicate materials such as a fine mesh or hand-tied lace may be preferable to create a more natural-looking hair part. Strands or wefts of hair may be glued or otherwise adhered or attached to the outer surface of the hair-part inlay 420, however, in some embodiments, in which the user may desire to cut the hair-part inlay, as shown in FIG. 4B, to pull some of the user's own hair through to increase the natural-looking effect of the hair part, it may be preferable to avoid securing hair wefts 330 perpendicularly to the hair-part inlay 420. A reinforced border 430 may be sewn or otherwise coupled to at least a portion of the perimeter of the hair-part inlay 420 to prevent unintended tearing or separation of the hair-part inlay 420 beyond a cut or slit made by the user. By extending the hair-part inlay 420 with reinforced border along three sides and unreinforced along the front 340 of the wig, the user can choose whether to cut the hair-part inlay fully or partially to allow the user's hair to extend through the hair-part inlay 420. The reinforced border 430 may be comprised of any material such as, fabric, thread, etc. that is of sufficient strength to prevent undesired tearing of the hair-part inlay 420. While the hair-part inlay 420 and reinforced fabric portion 320 of the cap 300 may be comprised of any suitable material that enhances and provides comfort for the user such as an elastic material, in some implementations, it may be preferable that one or both of these components are comprised of a substantially non-elastic material to prevent unintentional distortion of the hair part during use or installation.

Implementations of the weaveable wig therefore, provide natural-looking coverage of a user's real hair without the need for damaging glues or adhesives and with ease of styling due to the weaveable wig being securely sewn to the user's hair and comfortably stretched over the user's head.

Figure 6:
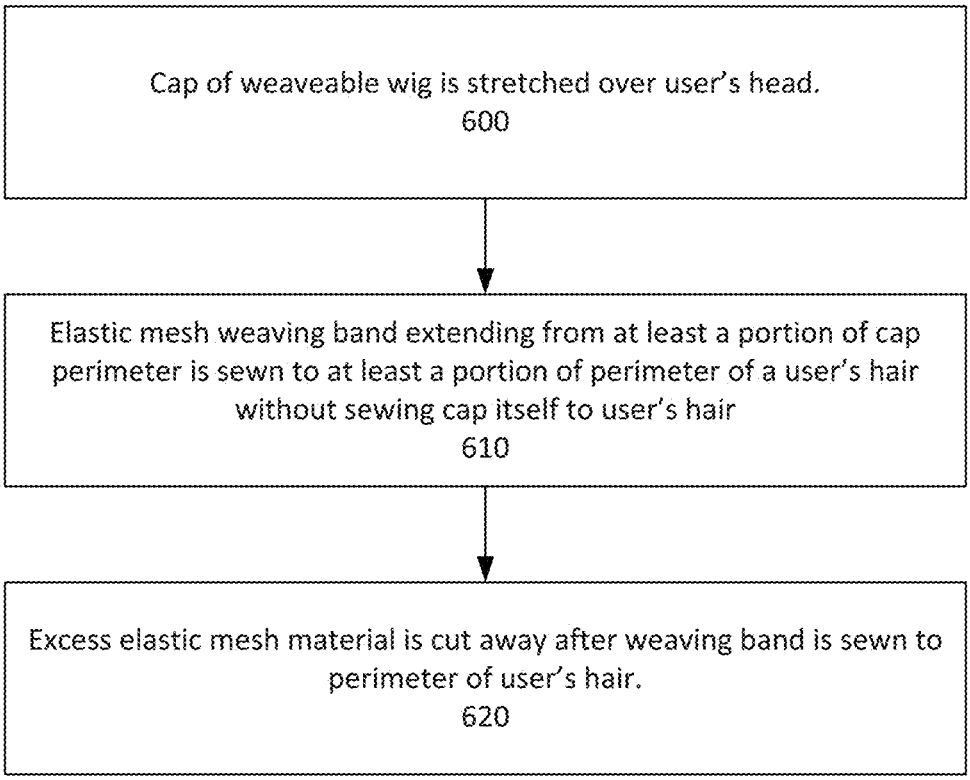
FIG. 6 is a block diagram of an implementation of a method of attaching a weaveable wig to a user's head.

FIG. 6 depicts an implementation of a method of securing a weaveable wig to a user's head. As shown, a cap of the weavable wig is stretched over the head of a user 600. The cap may be comprised of a plurality of weft-securing members that run longitudinally relative to the user's head. The weft-securing members may be comprised of an elasticized material to allow for ease of stretching the cap over the user's head as well as a proper fit that is not loose or baggy. A plurality of hair wefts may be secured to the longitudinal weft-securing members and may be comprised of natural or artificial hair in any color or style that the user desires. A weaving or other needle in conjunction with thread or any other appropriate securing fiber is used to sew only a weaving band that extends outward from at least a portion of a perimeter of the cap to at least a portion of the perimeter of a user's hair 610. The weaving band may be comprised of a stretchable elasticized mesh that may be comprised of nylon and polyurethane fabric such as synthetic elastane fiber like that made under the name Spandex. In one particular embodiment, the elastic mesh comprises about 80% nylon and about 20% spandex. Although this particular composition is useful, other compositions may also be useful. For example, the nylon composition may advantageously be within the range of 65% to 90% nylon and within the range of 10% to 35% spandex. Other ranges are also contemplated and useful. Rather than sewing individual wefts of hair or an entire wig cap to a user's head, the present implementation allows for significant time savings by providing a securely fitting and well attached full or partial wig as a result of sewing the weaving band to at least a portion of the perimeter of the user's hair rather than sewing other portions of the wig to the rest of the user's head. Once the desired portion of the weaving band has been sewn to the user's head, the elastic mesh material of the weaving band may be cut away so that it is not visible on the wearer's head and provides a natural looking hairstyle 620.

In some implementations of the method, it may be preferable to braid or otherwise secure the user's hair to provide a sewing base for ease of sewing the weaving band to the user's hair. This may be done solely around at least a portion of the user's head or the entire head may be braided or otherwise secured. Regardless of how much hair is braided, the sewing base need only be present around at least a perimeter of the user's head as this is where the elastic mesh weaving band is secured to the user's natural hair.

While it is intended that the weaveable wigs of this disclosure are designed to fit any head size, most wearers have a head circumference in the range of approximately 20.25-23 inches as measured around the wearer's head from the front of the hairline to the back of the wearer's neck.

Figure 7:
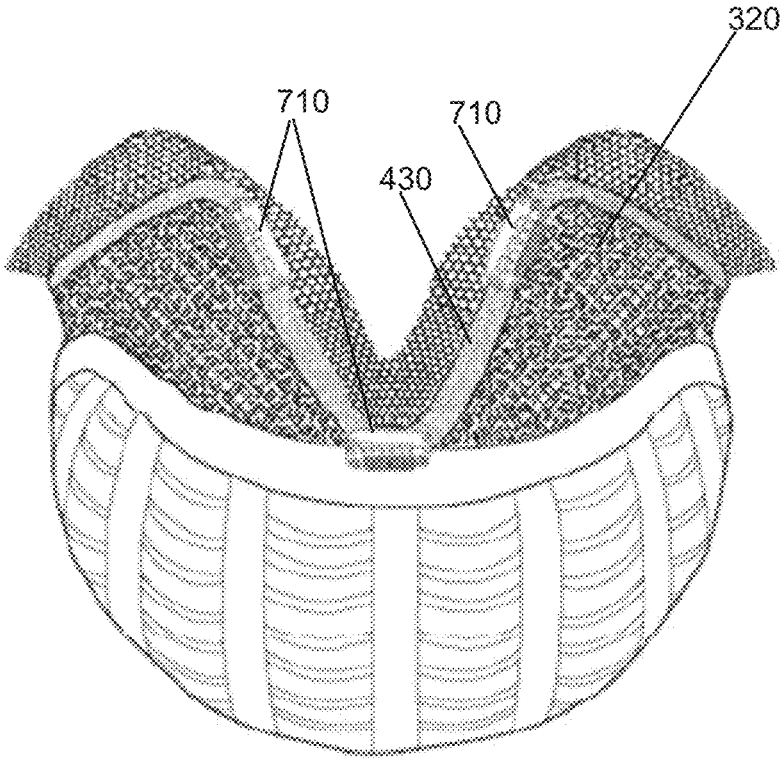
FIG. 7 depicts an implementation of a weaveable wig comprising an enlarged hair-part opening with a reinforced border.

As shown in FIG. 7, in some embodiments, the weaveable wig may comprise an enlarged hair part opening to allow for more of the wearer's real hair to be pulled through thereby creating a more natural look for the wearer. While the enlarged frontal hair part opening may be of any size, in some embodiments, a frontal hair part opening having a width within a range of approximately 0.25-4.50 inches may be preferable to provide a wearer an option to choose how much of the wearer's own hair the wearer desire to pull through the weaveable wig to create a more natural and individualized look. Also depicted here, but applicable to any of the previously described embodiments as well, the enlarged frontal hair part opening may necessitate the addition of one or more clips, combs, or other securing mechanisms 710 which may be used to aid in securing the weaveable wig to the user's real hair. These additional securing mechanisms 710 may be coupled to the reinforced border 430 or any other appropriate location to provide an adequate amount of fixation to the user's real hair for a more natural look.

In places where the description above refers to particular implementations of weaveable wigs, it should be readily apparent that a number of modifications may be made without departing from the spirit thereof and that these implementations may be applied to other wigs and hairpieces.

The invention claimed is:

1. A method of securing a weaveable wig to a user's head comprising:

stretching a cap of a weaveable wig over the head of the user;

sewing, using a weaving needle and thread, only a weaving band comprising an elastic mesh material that extends outward from a majority of a perimeter of the cap to at least a portion of a perimeter of a user's hair without sewing any of the cap of the weaveable wig to the user's hair; and cutting away at least a portion of the elastic mesh material of the weaving band after the weaving band has been sewn to the at least a portion of the perimeter of the user's hair.

2. The method of claim 1, further comprising providing a sewing base around the at least a portion of the perimeter of the user's hair by braiding at least a portion of the perimeter of the user's hair.

3. The method of claim 1, further comprising providing a sewing base around the at least a portion of the perimeter of the user's hair by braiding less than all of the user's hair.

4. The method of claim 1, wherein the elastic mesh material is comprised of nylon and spandex and is of a strength great enough to prevent tearing of the elastic mesh when tension is applied to the thread when sewing the weaving band to the at least a portion of the perimeter of the user's head.

* * * * *